United States Patent [19]

Hasegawa

[11] Patent Number: 4,513,722

[45] Date of Patent: Apr. 30, 1985

[54] METHOD FOR CONTROLLING FUEL SUPPLY TO INTERNAL COMBUSTION ENGINES AT ACCELERATION IN COLD CONDITIONS

[75] Inventor: Shumpei Hasegawa, Niiza, Japan

[73] Assignee: Honda Giken Kogyo Kabushiki Kaisha, Tokyo, Japan

[21] Appl. No.: 498,272

[22] Filed: May 26, 1983

Related U.S. Application Data

[62] Division of Ser. No. 348,648, Feb. 12, 1982, Pat. No. 4,445,483.

[51] Int. Cl.[3] ..... F02M 51/02

[52] U.S. Cl. ..... 123/492

[58] Field of Search ..... 123/480, 486, 487, 492

[56] References Cited

U.S. PATENT DOCUMENTS

| | | | |
|---|---|---|---|
| 4,245,605 | 1/1981 | Rice et al. | 123/492 |
| 4,313,412 | 2/1982 | Hasaka et al. | 123/480 |
| 4,356,803 | 11/1982 | Miyagi | 123/492 |
| 4,359,993 | 11/1982 | Carlson | 123/492 |
| 4,364,363 | 12/1982 | Miyagi et al. | 123/492 |
| 4,416,240 | 11/1983 | Matsuoka | 123/480 X |
| 4,469,074 | 9/1984 | Takao et al. | 123/492 |

*Primary Examiner*—Tony M. Argenbright

*Attorney, Agent, or Firm*—Arthur L. Lessler

[57] ABSTRACT

A method for electronically controlling fuel metering means for metering the quantity of fuel being supplied to an internal combustion engine, wherein a basic fuel quantity corresponding to a condition in which the engine is operating is corrected by the use of a first correction coefficient having a value dependent upon the engine temperature, so as to supply a required quantity of fuel to the engine. When the engine is accelerated while it is in a cold condition, the value of a second correction coefficient is set as a function of the value of the first correction coefficient, and the above basic fuel quantity is corrected by the value of the second correction coefficient thus set. Preferably, the basic fuel quantity is corrected in such a manner that an acceleration fuel increment dependent upon an accelerating condition of the engine is multiplied by the value of the second correction coefficient, and the resulting product is added to the basic fuel quantity. The second correction coefficient is applicable to both synchronous acceleration fuel increasing control synchronized with generation of a signal indicative of a predetermined crank angle of the engine, and asynchronous acceleration fuel increasing control effected independently of the above signal.

9 Claims, 12 Drawing Figures

METHOD FOR CONTROLLING FUEL SUPPLY TO INTERNAL COMBUSTION ENGINES AT ACCELERATION IN COLD CONDITIONS

CROSS REFERENCE TO RELATED APPLICATION

The present application is a divisional application from U.S. Ser. No. 348,648 filed Feb. 12, 1982 by Shumpei Hasegawa, now issued as U.S. Pat. No. 4,445,483.

BACKGROUND OF THE INVENTION

This invention relates to a fuel supply control method for internal combustion engines, and more particularly to such method which is adapted to increase the quantity of fuel being supplied to the engine to a quantity appropriate to the operating condition of the engine during acceleration of the engine while the engine is in a cold condition, thereby improving the accelerability of the engine.

A fuel supply control system adapted for use with an internal combustion engine, particularly a gasoline engine has been proposed e.g. by U.S. Pat. No. 3,483,851, which is adapted to determine the valve opening period of a fuel quantity metering or adjusting means for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

Even though the above fuel supply control system is applied to an internal combustion engine, the fuel injected into the intake pipe of the engine is not vaporized to a sufficient extent when the engine is in a cold state, so that the mixture being supplied to the engine often cannot have a required air/fuel ratio, resulting in degradation in the driveability and emission characteristics of the engine. The rate of vaporization of fuel injected into the intake pipe is a function of the temperature of the engine as well as the pressure within the intake pipe. That is, the lower the intake pipe absolute pressure, the higher the rate of vaporization becomes. A fuel supply control method, which is based upon this fact, is known e.g. from Japanese Patent Publication No. 54-268, in which the fuel supply quantity is corrected by means of a correction coefficient which is a function of the engine temperature and the intake pipe pressure during normal operation of the engine while the engine is in a cold condition before it is supplied to the engine.

On the other hand, during acceleration of the engine, in order to enhance the accelerability of the engine, an increased quantity of fuel is supplied to the engine. The accelerating increment of fuel quantity should be set to a larger value when the engine is accelerated in a cold state, so as to compensate for a drop in the rate of vaporization of fuel as stated above.

SUMMARY OF THE INVENTION

It is an object of the invention to provide a fuel supply control method which is adapted to increase the quantity of fuel being supplied to the engine to a quantity appropriate to the operating condition of the engine during acceleration of the engine while the engine is in a cold state, thereby improving the accelerability of the engine.

The present invention is based upon the recognition that the ratio of a fuel supply quantity required at acceleration of the engine in a cold condition to that required at acceleration of the engine when the engine is a warmed-up condition varies in close relation to the ratio of a fuel supply quantity required during normal operation of the engine in a cold condition to that required during normal operation of the engine in a warmed-up condition.

The invention provides a method for electronically controlling fuel metering means for metering the quantity of fuel being supplied to an internal combustion engine, wherein a basic fuel quantity which is set to a value corresponding to a condition in which the engine is operating, the value of the basic fuel quantity thus set is corrected by means of correction coefficients including at least a first correction coefficient having a value dependent upon the temperature of the engine and a second correction coefficient, and the corrected quantity of fuel is supplied to the engine. The method of the invention is characterized by the following steps: (a) setting the value of the second correction coefficient as a function of the value of the first correction coefficient, (b) determining whether or not the engine operating is in an accelerating condition, and (c) when it is determined in the step (b) that the engine is operating in such accelerating condition, correcting the above basic fuel quantity by the value of the second correction coefficient set in the step (a), and (d) supplying the corrected fuel quantity to the engine.

It is a further object of the invention to provide a fuel supply control method in which a common correction coefficient is used for correction of the quantity of fuel being supplied to the engine during acceleration while the engine is in a cold condition both during fuel supply control synchronous with a signal indicative of a predetermined crank angle of the engine and during fuel supply control not synchronous with such signal, thereby achieving further enhanced accelerability of the engine.

According to a second aspect of the invention, a method for electronically controlling fuel metering means for metering the quantity of fuel being supplied to an internal combustion engine, wherein a first basic fuel quantity, which is set to a value corresponding to a condition in which the engine is operating is corrected by means of correction coefficients including at least a first correction coefficient having a value dependent upon the temperature of the engine, and a second correction coefficient, each time each pulse of a first signal is generated at each predetermined crank angle of the engine, and the corrected quantity of fuel is supplied to the engine. The method according to the second aspect of the invention is characterized by the following steps: (a) setting a second basic fuel quantity to a value corresponding to the operating condition of the engine each time each pulse of a second signal is generated, which has a constant pulse repetition period independent of the predetermined crank angle of the engine, (b) setting the value of a second correction coefficient as a function of the value of the first correction coefficient, (c) determining whether or not the engine is operating in an accelerating condition, (d) when it is determined in the step (c) that the engine is operating in such accelerating condition, correcting the first and second basic fuel quantities by means of the value of the second correction coefficient set in the step (b) and (e) supplying the resulting corrected first basic fuel quantity to the engine in a manner synchronous with generation of each pulse of the above first signal, and the resulting corrected second basic quantity in a manner synchronous with generation of each pulse of the above second signal, respectively.

Preferably, the value of the second correction coefficient (KTWT), as applied by the first and second aspects of the invention, is set to a value larger than the value of the first correction coefficient KTW, and is determined by the following equation:

$$KTWT = CTWT\,(KTW - 1.0) + 1.0$$

where CTWT is a constant larger than 1.

Further preferably, the first basic fuel quantity, as applied by the first and second of the invention, is corrected in such a manner that an acceleration fuel increment having a value corresponding to the accelerating condition of the engine is multiplied by the value of the second correction coefficient, and the resulting product is added to the first basic fuel quantity.

The above and other objects, features and advantages of the invention will be more apparent from the ensuing detailed description taken in connection with the accompanying drawings in which:

DETAILED DESCRIPTION

The invention will now be described in detail with reference to the drawings.

Figure 1:
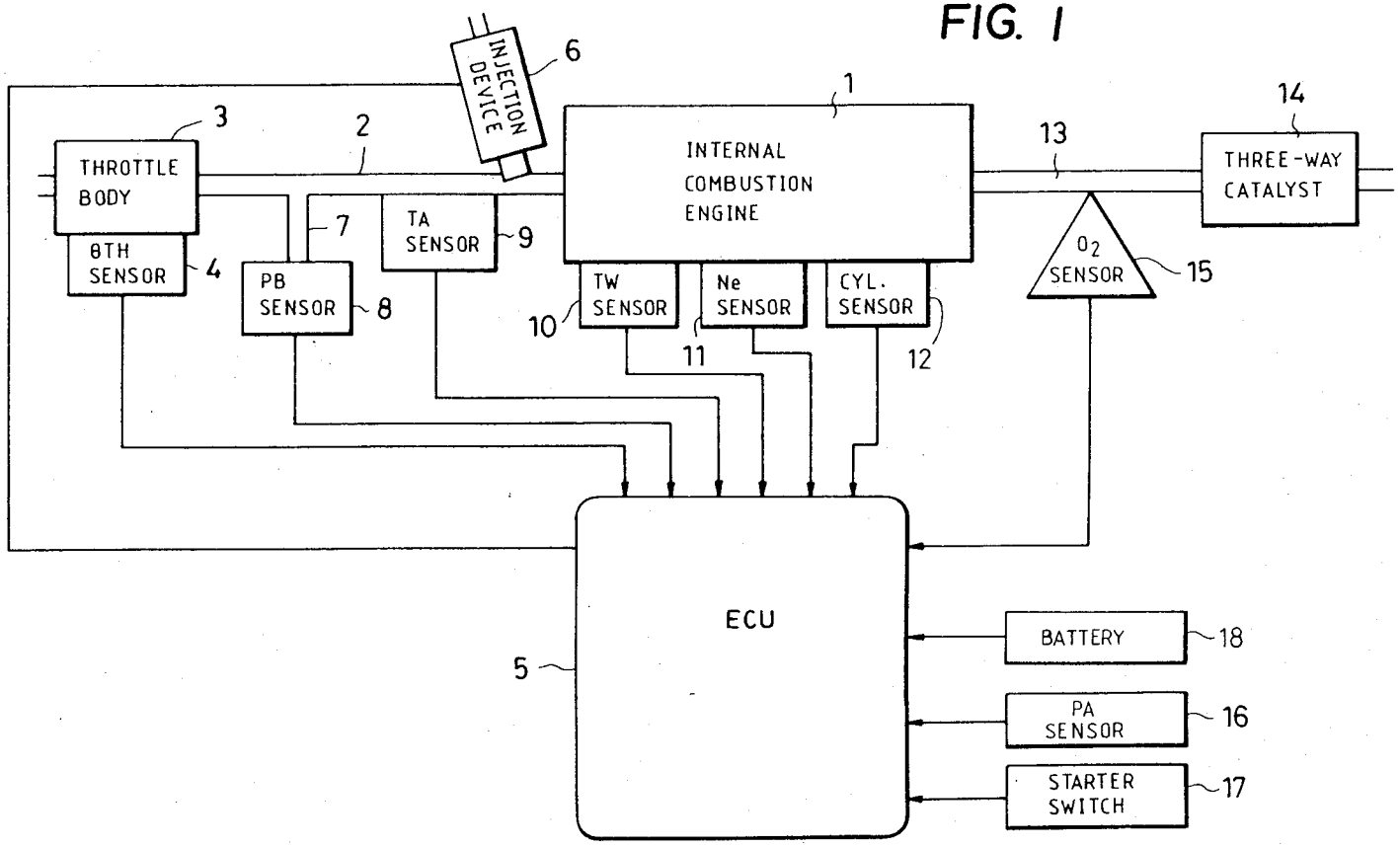
FIG. 1 is a block diagram illustrating the whole arrangement of an electronic fuel injection control system according to the present invention.
Figure 2:
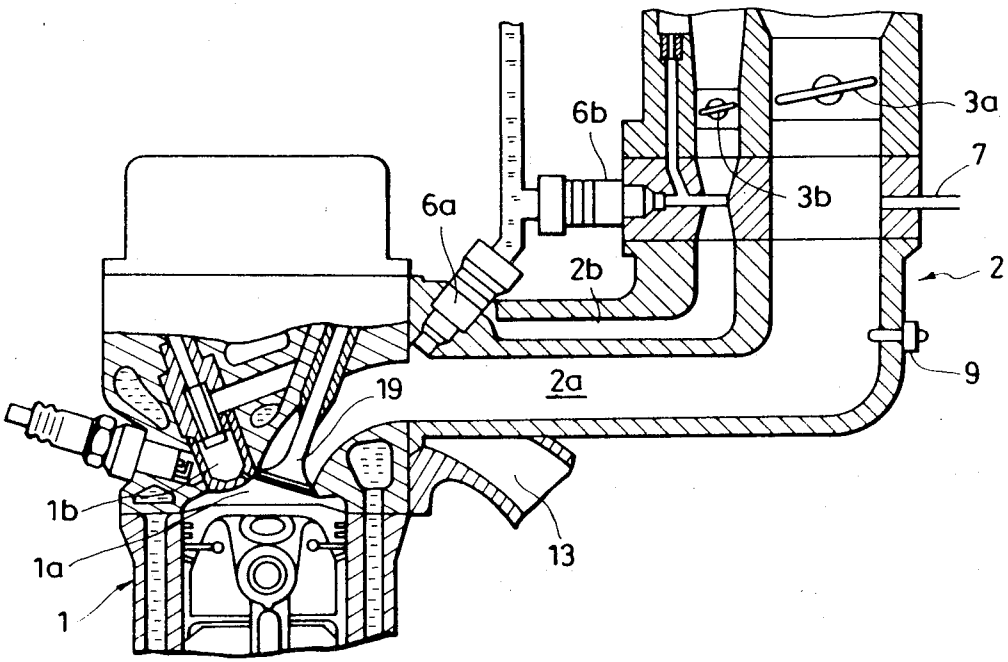
FIG. 2 is a view illustrating details of the engine in FIG. 1 and its peripheral parts.

FIG. 1 illustrates the whole arrangement of a fuel injection control system for internal combustion engines, to which the present invention is applicable, and FIG. 2 illustrates details of the engine in FIG. 1 and its peripheral parts. Reference numeral 1 designates an internal combustion engine which may be a four-cylinder type, for instance. This engine 1 has main combustion chambers 1*a* which may be four in number and sub combustion chambers 1*b* communicating with the respective main combustion chambers 1*a*. An intake pipe 2 is connected to the engine 1, which comprises a main intake pipe 2*a* communicating with each main combustion chamber 1*a*, and a sub intake pipe 2*b* with each sub combustion chamber 1*b*, respectively. Arranged across the intake pipe 2 is a throttle body 3 which accommodates a main throttle valve 3*a* and a sub throttle valve 3*b* mounted in the main intake pipe and the sub intake pipe, respectively, for synchronous operation. A throttle valve opening sensor 4 is connected to the main throttle valve 3*a* for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors 6*a* and a subinjector 6*b*. The main injectors correspond in number to the engine cylinders and are each arranged in the main intake pipe 2*a* at a location slightly upstream of an intake valve 19 of a corresponding engine cylinder, while the subinjector 6*b*, which is single in number, is arranged in the sub intake pipe 2*b* at a location slightly downstream of the sub throttle valve 3*b*, for supplying fuel to all the engine cylinders. The main injectors 6*a* and the subinjector 6*b* are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe 2*a* at a location immediately downstream of the throttle valve 3*a* of the throttle body 3. The absolute pressure sensor 8 is adapted to detect absolute pressure in the intake pipe 2 and supplies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying thereto an electrical signal indicative of detected intake-air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter 12 is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure, a starter switch 17 for actuating the starter, not shown, of the engine 1, and a battery 18, respectively, for supplying an electrical signal indicative of detected atmospheric pressure, a supply voltage from the battery 18, and an electrical signal indicative of own on and off positions of the starter switch 17 to the ECU 5.

Next, the fuel quantity control operation of the fuel injection control system of the invention arranged as above will now be described in detail with reference to FIGS. 1 and 2 referred to hereinabove and FIGS. 3 through 12.

Figure 3:
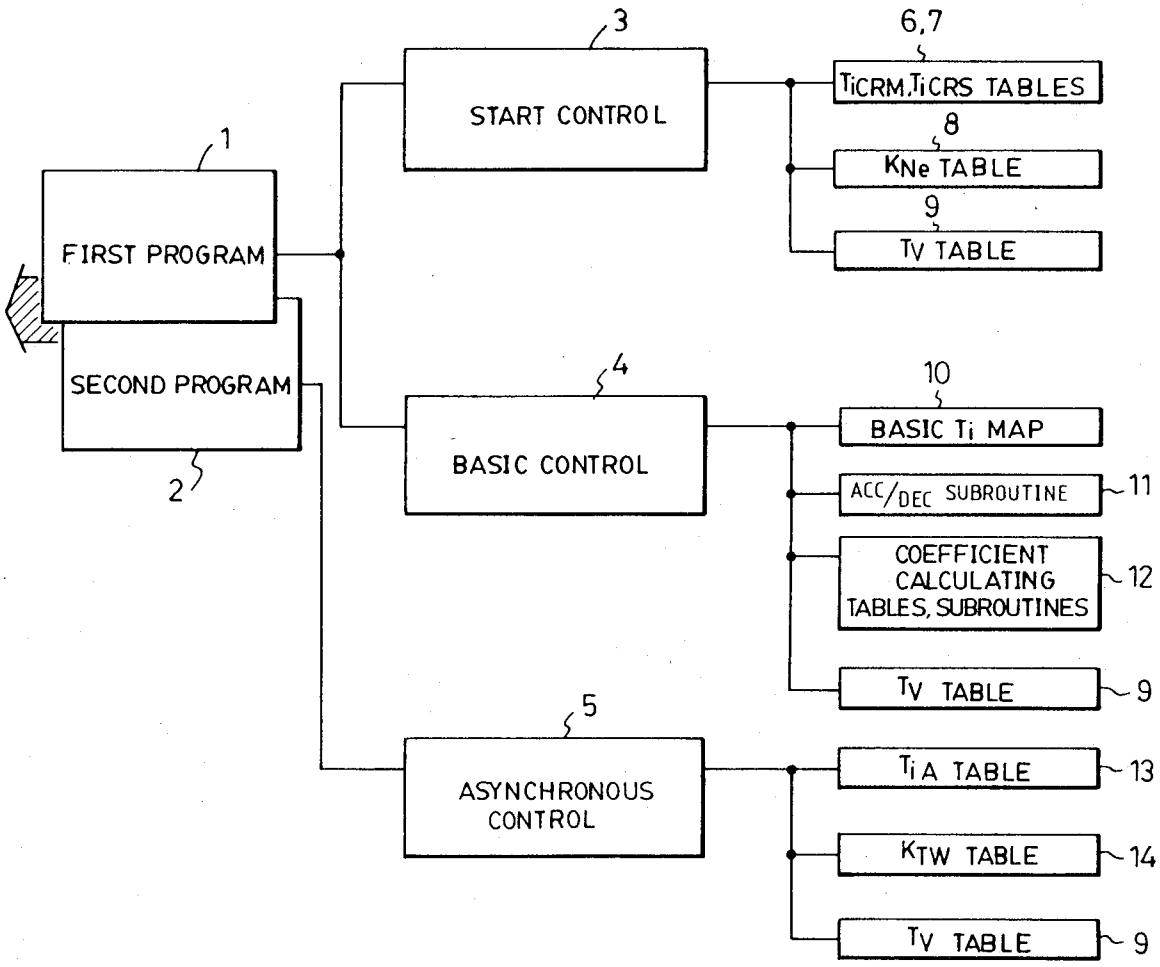
FIG. 3 is a block diagram illustrating a program for control of the valve opening periods TOUTM, TOUTS of the main injectors and the subinjector, which are operated by an electronic control unit (ECU) in FIG. 1.

Referring first to FIG. 3, there is illustrated a block diagram showing the whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTW \times KAST \times KPA) + TV \quad (4)$$

where TiM, TiS represent basic values of the valve opening periods for the main injectors and the subinjector, respectively, and are determined from a basic Ti map 10, and TDEC, TACC represent constants applicable, respectively, at engine deceleration and at engine acceleration and are determined by acceleration and deceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometeric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 4:
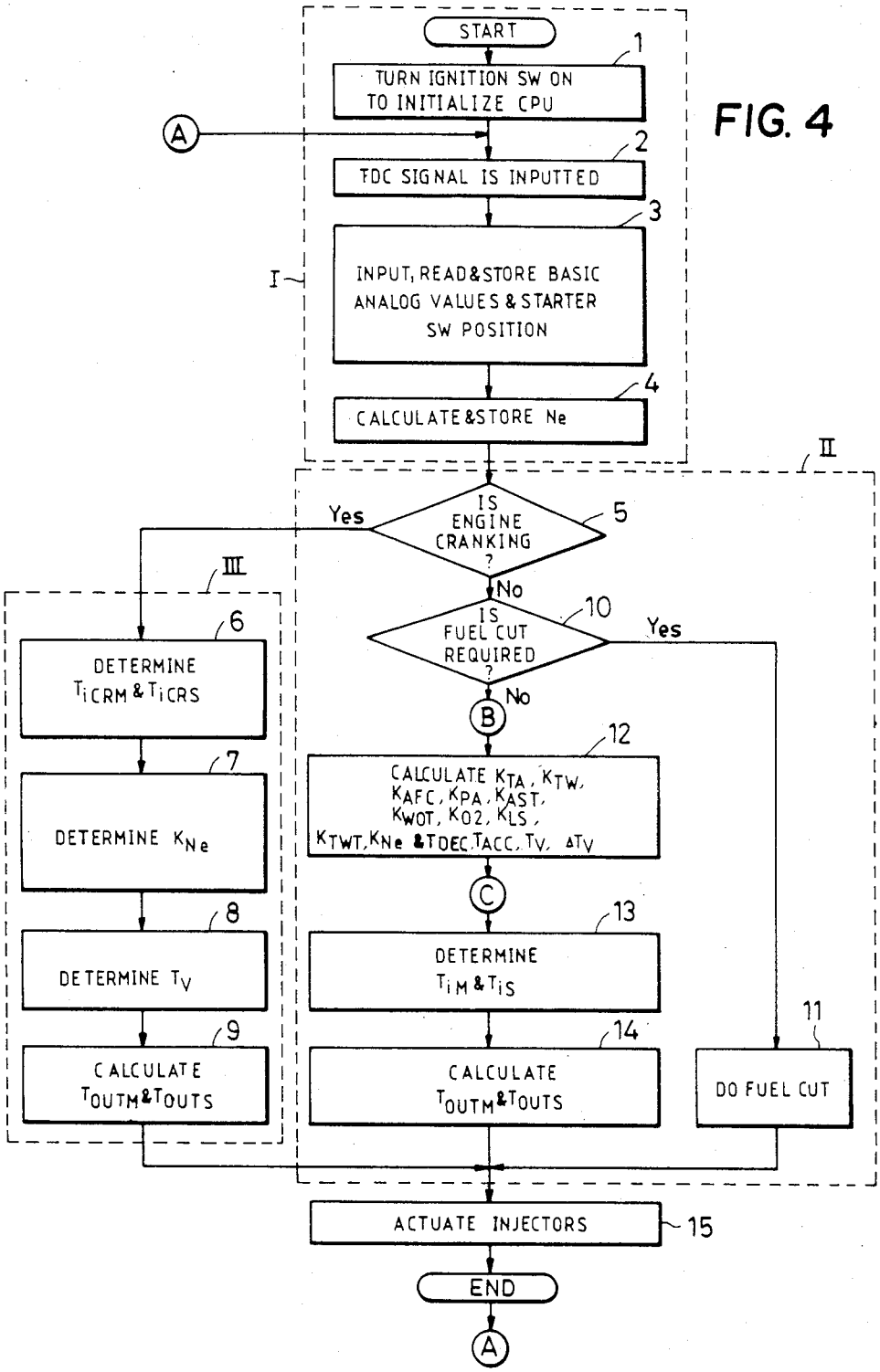
FIG. 4 is a flow chart showing a main program for control of the basic valve opening periods TOUTM, TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch, not shown, of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, intake-air temperature TA, throttle valve opening θth, battery voltage V, output voltage value V of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to 14 the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV, and ΔTV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values, TOUTM, TOUTS on the basis of the values of correction coefficients and correction constants selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

Details of the above-stated TDC signal-synchronized control will now be described:

TDC Signal-Synchronous Control

Water Temperature-Dependent Fuel Increasing Coefficient KTW

Figure 5:
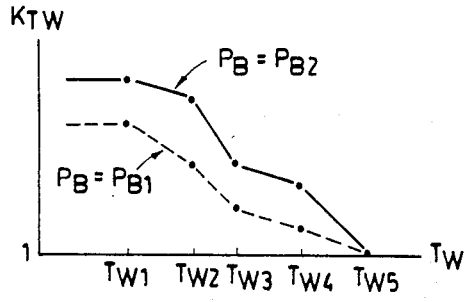
FIG. 5 is a view showing a table of the relationship between engine cooling water temperature TW and water temperature-dependent fuel increasing coefficient KTW.
Figure 6:
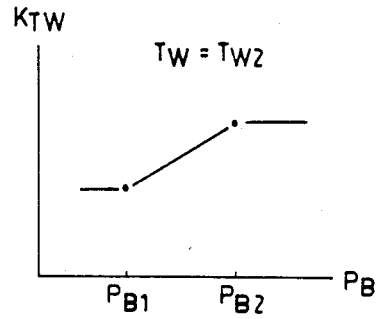
FIG. 6 is a graph showing the relationship between absolute pressure PB and water temperature-dependent fuel increasing coefficient KTW, based on the assumption that water temperature TW remains unchanged.

FIG. 5 shows a KTW table plotting the relationship between the engine cooling water temperature TW and the water temperature-dependent fuel increasing coefficient KTW. It is noted from the table that the coefficient KTW has a value of 1 when the water temperature TW is higher than a predetermined value TW5 (e.g. 60 C.), while in the event that the water temperature TW is lower than the above predetermined value TW5, the value of the coefficient KTW is selected from five different values of KTW provided, respectively, for five predetermined values of water temperature TW1−5 which form calibration variants. When the water temperature TW shows a value other than the variants TW1−5, the value of KTW is determined by means of an interpolation method. FIG. 6 is a graph plotting the relationship between the absolute pressure PB and the coefficient KTW, based on the assumption that the water temperature TW remains constant. According to this graph, there are provided two predetermined absolute pressure values PBl (e.g. 400 mmHg) and PB2 (e.g. 300 mmHg) as examples of the absolute pressure PB. When the absolute pressure PB is lower than PBl or higher than PB2, the coefficient KTW has a constant value. When the absolute pressure PB lies between the two predetermined values PB1, PB2, the value of KTW is determined by means of an interpolation method. In determining the value of KTW by means of an interpolation method, the interpolation calculation based on TW may be preceded by that based on PB.

Water Temperature-Dependent Fuel Increasing Coefficient KTWT Applicable at Synchronous Acceleration Control and Asynchronous Acceleration Control The value of water temperature-dependent fuel increasing coefficient KTWT which is applied during acceleration control which is effected in synchronism with the TDC signal (hereinafter called "synchronous acceleration control"), and TDC signal-asynchronous acceleration control is determined from the following equation:

$$KTWT = CTWT\,(KTW - 1.0) \qquad (6)$$

where CTWT is a calibration constant and is set at a value within a range of 1–3, for instance.

As noted above, the water temperature-dependent fuel increasing coefficient KTWT can be calculated as a function of the value of the water temperature-dependent fuel increasing coefficient KTW applicable during normal operation of the engine. This can make the configuration of the circuit for calculation of the coefficient KTWT much more simple than that for calculation of the coefficient KTW, thus contributing a simplification of the circuit configuration within the ECU.

Figure 7:
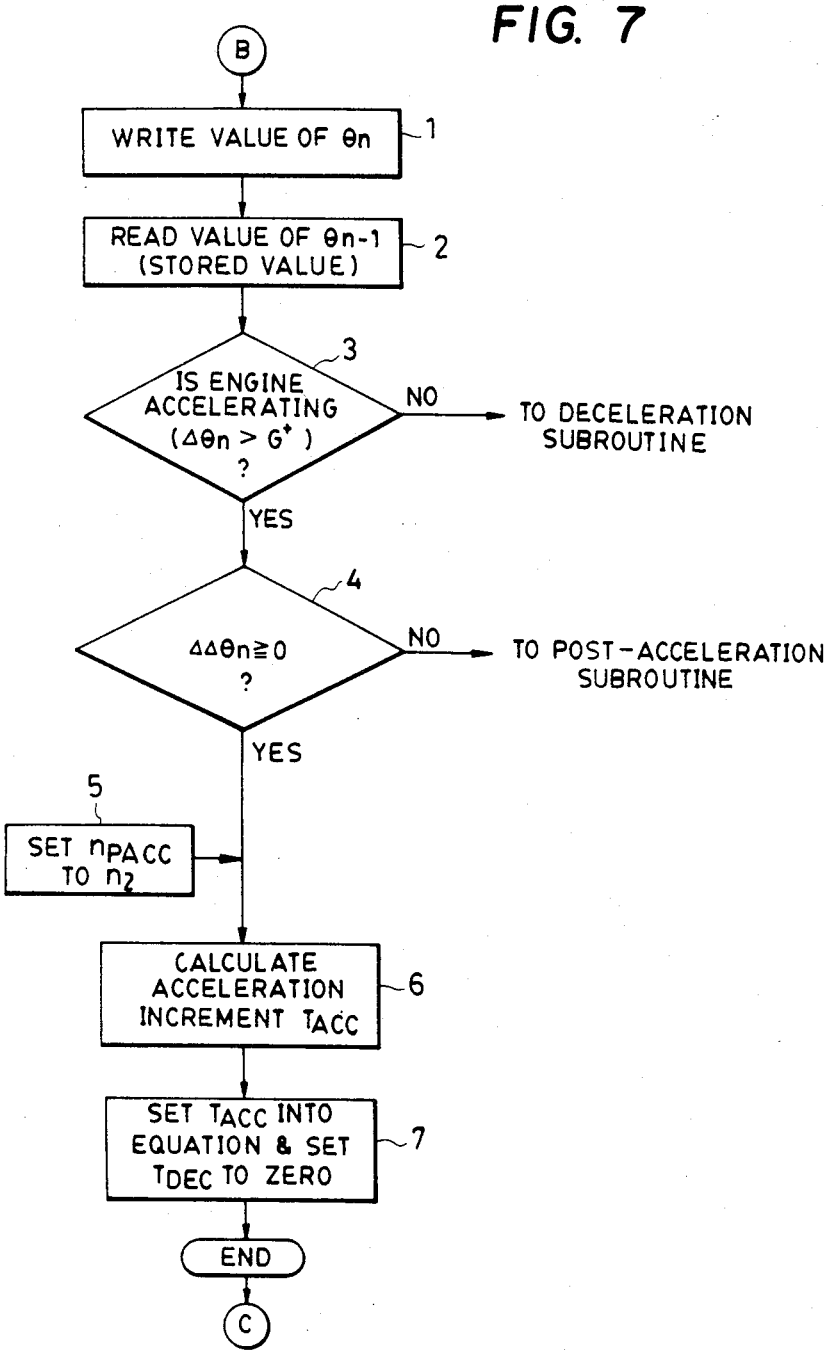
FIG. 7 is a flow chart showing a subroutine for calculation of acceleration fuel increasing constants TACC, being applicable during TDC signal-synchronized fuel supply control operation.

Subroutine for Calculation of Fuel Increasing Constant TACC Applicable At Synchronous Acceleration Control FIG. 7 shows a flow chart of a subroutine for calculating the fuel increasing constant TACC applicable at TDC signal-synchronous acceleration.

Figure 8:
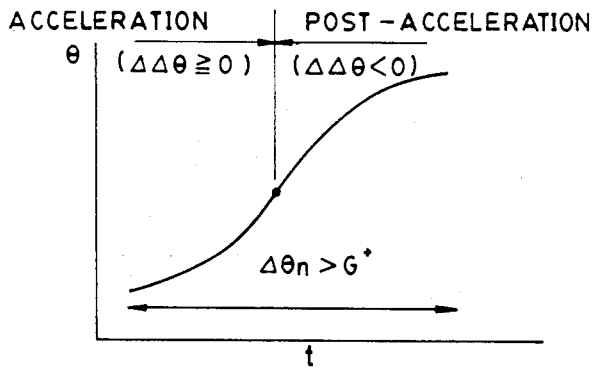
FIG. 8 is a view showing a curve of the relationship between throttle valve opening $\theta$ and time t, based on the assumption that engine rpm Ne remains constant and throttle valve opening $\Delta\theta$ is larger than a predetermined value $G^+$.
Figure 9:
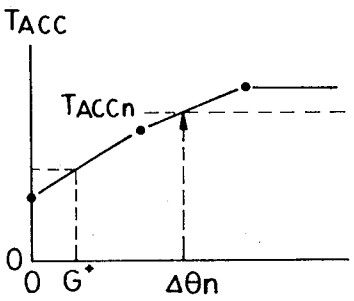
FIG. 9 is a view showing a table of the relationship between throttle valve opening variation $\Delta\theta n$ and acceleration fuel increasing constant TACC.
Figure 10:
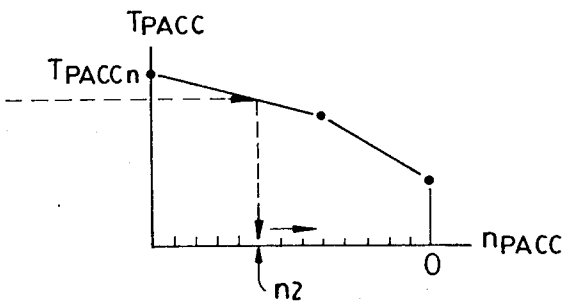
FIG. 10 is a view showing a table of the relationship between the number of TDC signal pulses NPACC counted after accelerating operation and postacceleration fuel increasing constant TPACC.

First, the value θn of the throttle valve opening is read into a memory in ECU 9 upon application of each TDC signal pulse to ECU 9 (step 1). Then, the value θn−1 of the throttle valve opening in the previous loop is read from the memory at the step 2, to determine whether or not the difference Δθn between the value θn and the value θn−1 is larger than a predetermined synchronous acceleration control determining value G+, at the step 3. If the answer is yes at the step 3, a further determination is made as to whether the difference ΔΔθn between the difference Δθn in the present loop and the difference Δθn−1 in the previous loop is equal to or larger than zero, at the step 4. If the answer is yes, the engine is determined to be accelerating, and if the answer is no, it is determined to be in a post-acceleration state. The above differential value $\Delta\Delta\theta n$, which is shown in FIG. 8, is equivalent to a value obtained by twice differentiating the throttle valve opening value $\Delta n$. Whether the engine is accelerating or after acceleration is determined with reference to the point of contraflexure of the throttle valve opening value curve and in dependence upon the direction of change of the throttle valve opening. When it is determined at the step 4 that the engine is accelerating, the number of post-acceleration fuel increasing pulses n2 corresponding to the variation $\Delta\theta n$ is set into a post-acceleration counter as a count nPACC (step 5). FIG. 9 and FIG. 10 show tables showing, respectively, the relationship between the variation $\Delta\theta n$ of the throttle valve opening and the acceleration fuel increasing constant TACC, and the relationship between the count nPACC and the post-acceleration fuel increasing constant TPACC. By referring to FIG. 9, a value TACCn of acceleration fuel increasing constant TACC is determined which corresponds to a variation $\Delta\theta n$. Then, by referring to FIG. 10, a value TPACCn of post-acceleration fuel increasing constant TPACC is determined which corresponds to the value TACCn determined above, followed by determining the value of post-acceleration fuel increasing pulses n2 from the value TPACCn determined. That is, the larger the throttle valve opening variation $\Delta\theta n$, the larger the post-acceleration fuel increment is. Further, the larger the variation $\Delta\theta n$, the larger value the post-acceleration count nPACC is set to, so as to obtain a longer fuel increasing period of time.

Simultaneously with the above step 5, the value of acceleration fuel increasing constant TACC is determined from the table of FIG. 9, which corresponds to the throttle valve opening variation $\Delta\theta n$ (step 6). The TACC value thus determined is set into the aforementioned equation (3), and simultaneously the deceleration fuel decreasing constant TDEC is set to zero, at the step 7.

DETERMINATION OF BASIC VALUES TiM, TiS OF VALVE OPENING PERIODS OF MAIN INJECTORS AND SUBINJECTORS

These basic values TiM, TiS are selected from predetermined basic values TiM, TiS previously stored in storage means within the ECU 5, as values to corresponding to actual values of engine rpm Ne and intake pipe absolute pressure PB. The above predetermined values TiM, TiS are previously determined as corresponding to respective ones of a plurality of predetermined values of engine rpm and a plurality of predetermined values of intake pipe absolute pressure.

TDC Signal-Asynchronous Control

The system of the present invention employs asynchronous valve opening period control which controls the main injectors not in synchronism with the TDC signal but with a pulse train having a constant pulse separation, in addition to the aforementioned TDC signal-synchronous valve opening period control for the main injectors and the subinjector. The asynchronous valve opening period control will now be described. As previously stated, the valve opening period TMA of the main injectors according to the asynchronous control is calculated from the aforementioned equation (5).

The above asynchronous control is intended to make up for a shortage in the acceleration fuel increment synchronous with the TDC signal which is applied at rapid acceleration or the like.

Asynchronous Acceleration Control Subroutine

Figure 12:
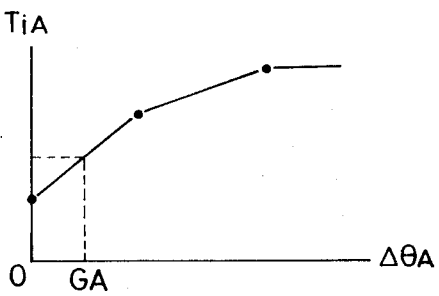
FIG. 12 is a view showing a table of the relationship between throttle valve opening variation $\Delta\theta A$ and basic fuel increasing constant TiA applicable at TDC signal-asynchronous acceleration.
Figure 11:
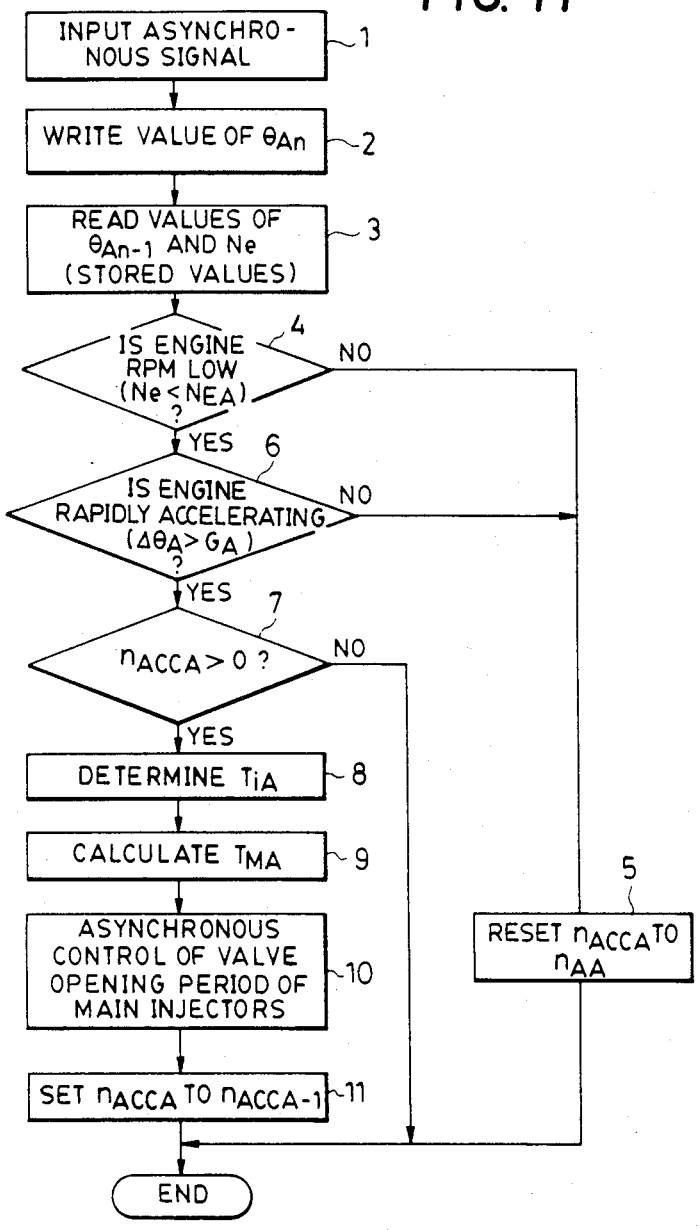
FIG. 11 is a flow chart showing a subroutine for acceleration in asynchronism with TDC signal.

FIG. 11 shows a flow chart of a subroutine for carrying out the asynchronous acceleration control. First, asynchronous signal pulses are inputted to an associated counter in ECU 9 at constant intervals (e.g. every 20 ms), independently of the TDC signal pulses (step 1). The pulse separation of this asynchronous signal may be set at a value within a range of 10–50 ms. Then, each time one pulse of the asynchronous signal is inputted, the value $\theta An$ of the throttle valve opening is written into an associated register in ECU 9, at the step 2. The throttle valve opening value $\theta An-1$ and the engine rpm Ne value which were stored in ECU upon inputting of the previous pulse are read from their respective registers in ECU, at the step 3. Then, the engine rpm Ne value thus read out is compared with a predetermined asynchronous acceleration control determining rpm NEA (e.g. 2800 rpm) at the step 4. The predetermined rpm NEA is set at a value within a range of 50–6000 rpm, for instance. If the answer to the above comparison is no, a pulse number nACCA stored in its register is resetted to its initial nAA (e.g. 2) at the step 5. If the answer to the question of the step 4 is yes, whether or not the difference between the two values $\theta An$ and $\theta An-1$ of the throttle valve opening, that is, the variation $\Delta\theta A$ is larger than a predetermined value GA (e.g. 20/sec) at the step 6. If the answer is negative, the program proceeds to the above step 5. If the answer is affirmative, it is determined at the step 7 whether or not the stored pulse number nACCA is larger than zero and simultaneously the asynchronous acceleration control fuel increment TiA is determined from the table of FIG. 12, at the step 8. FIG. 12 shows a graph of the relationship between the variation $\Delta\theta A$ of the throttle valve opening and the asynchronous acceleration control fuel increment TiA, from which the value of TiA is determined. Following the determination of TiA, the value of the valve opening period TMA for the main injectors is calculated from the aforementioned equation (5) at the step 9. In the equation (5), the coefficient KTWT and the constants TV, $\Delta$TV are renewed upon inputting of each TDC signal pulse to ECU, as previously mentioned. The valve opening period of the main injectors is controlled in accordance with the value of TMA calculated at the step 10. While the above steps 7–10 are carried out, 1 is subtracted from the aforementioned pulse number nACCA upon inputting of each pulse of the asynchronous signal at the step 11, and the above asynchronous control of the valve opening period is continued until the pulse number nACCA becomes zero to provide the negative answer to the question of the step 7.

Incidentally, when the asynchronous control is effected concurrently with the synchronous control, the valve opening period is calculated preferentially by means of the synchronous control.

What is claimed is:

1. A method for electronically controlling fuel metering means for metering the quantity of fuel being supplied to an internal combustion engine, wherein a basic fuel quantity is set to a value corresponding to a condition in which the engine is operating, and said value of said basic fuel quantity thus set is corrected by means of correction coefficients including at least a first correction coefficient having a value dependent upon the temperature of the engine as well as the load of the engine, and a second correction coefficient, so as to supply a required quantity of fuel to the engine, the method comprising the steps of:

(a) setting the value of said second coefficient as a funciton of said first correction coefficient;

(b) determining whether or not the engine is operating in an accelerating condition;

(c) when it is determined in said step (b) that the engine is operating in said accelerating condition, correcting said basic fuel quantity by the value of said correction coefficient set in said step (a); and (d) supplying the basic fuel quantity corrected in said step (c) to the engine.

2. The method according to claim 1, wherein said basic fuel quantity is corrected by correcting the value of said first correction coefficient before it is corrected by said second correction coefficient.

3. The method according to claim 1, further including the steps of:

setting an acceleration fuel increment to a value corresponding to the accelerating condition of the engine;

determining a product of the value of said acceleration fuel increment thus set and the value of said second correction coefficient set in said step (a); and correcting said basic fuel quantity by adding said product thereto.

4. A method for electronically controlling fuel metering means for metering the quantity of fuel being supplied to an internal combustion engine, wherein a basic fuel quantity is set to a value corresponding to a condition in which the engine is operating, and said value of said basic fuel quantity thus set is corrected by means of correction coefficients including at least a first correction coefficient having a value dependent upon the temperature of the engine, and a second correction coefficient, so as to supply a required quantity of fuel to the engine, the method comprising the steps of:

(a) setting said first correction coefficient to larger values as the temperature of the engine becomes lower, so as to increase said basic fuel quantity;

(b) setting the value of said second correction coefficient to a value larger than the value of said first correction coefficient;

(c) determining whether or not the engine is operating in an accelerating condition;

(d) when it is determined in said step (c) that the engine is operating in said accelerating condition, correcting said basic fuel quantity by the value of said second correction coefficient set in said step (b); and (e) supplying the basic fuel quantity corrected in said step (c) to the engine.

5. A method as claimd in claim 4, wherein the value of said second correction coefficient is determined by the following equation:

$$KTWT = CTWT\,(KTW - 1.0) + 1.0$$

where KTWT is said second correction coefficient, KTW said first correction coefficient, and CTWT a constant larger than 1.0.

6. A method as claimed in any of claims 4 or 5, wherein said basic fuel quantity is corrected by the value of said first correction coefficient before it is corrected by said second correction coefficient.

7. A method as claimed in any of claims 4 or 5, further including the steps of: setting an acceleration fuel increment to a value corresponding to the accelerating condition of the engine; determining a product of the value of said acceleration fuel increment thus set and the value of said second correction coefficient set in said step (a); and correcting said basic fuel quantity by adding said product thereto.

8. A method for electronically controlling fuel metering means for metering the quantity of fuel being supplied to an internal combustion engine, wherein a first basic fuel quantity is set to a value corresponding to a condition in which the engine is operating, each time each pulse of a first signal indicative of a predetermined crank angle of the engine is generated, and said value of said first basic fuel quantity thus set is corrected by means of correction coefficients including a first correction coefficient having a value dependent upon the temperature of the engine, and a second correction coefficient, so as to supply a required quantity of fuel to the engine, the method comprising the steps of: (a) setting a second basic fuel quantity to a value corresponding to the operating condition of the engine, each time each pulse of a second signal having a constant repetition period independent of said predetermined crank angle of the engine is generated: (b) setting the value of said second correction coefficient as a function of said first correction coefficient: (c) determining whether or not the engine is operating in an accelerating condition: (d) when it is determined in step (c) that the engine is operating in said accelerating condition, correcting said values of said first and second basic fuel quantities set above by the value of said second correction coefficient set in said step (b): and (e) supplying the first basic fuel quantity corrected in said step (d) to the engine in synchronism with generation of said first signal, while supplying said second basic fuel quantity corrected in said step (d) to the engine in synchronism with generation of said second signal.

9. A method as claimed in claim 8, further including the steps of: setting an acceleration fuel increment to a value corresponding to the accelerating condition of the engine; determining a product of the value of said acceleration fuel increment thus set and the value of said second correction coefficient set in said step (b); and correcting said first basic fuel quantity by adding said product thereto.

* * * * *